US007357499B2

(12) United States Patent
Kim

(10) Patent No.: US 7,357,499 B2
(45) Date of Patent: Apr. 15, 2008

(54) INKJET PRINT HEAD WITH MULTI-FUNCTIONAL STRUCTURE

(75) Inventor: Kwang-Ryul Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 243 days.

(21) Appl. No.: 11/063,538

(22) Filed: Feb. 24, 2005

(65) Prior Publication Data

US 2005/0264627 A1 Dec. 1, 2005

(30) Foreign Application Priority Data

May 25, 2004 (KR) ..... 10-2004-0037545

(51) Int. Cl.
*B41J 2/19* (2006.01)

(52) U.S. Cl. ..... 347/92; 347/94

(58) Field of Classification Search ..... 347/20, 347/44, 47, 56, 61–65, 67, 92–94
See application file for complete search history.

(56) References Cited

U.S. PATENT DOCUMENTS 5,463,413 A * 10/1995 Ho et al. ..... 347/65
5,734,399 A 3/1998 Weber et al. ..... 347/65
6,158,843 A 12/2000 Murthy et al. ..... 347/47
6,260,957 B1 7/2001 Corley, Jr. et al. ..... 347/63
6,270,201 B1 8/2001 Kasperchik et al. ..... 347/65
6,283,584 B1 * 9/2001 Powers et al. ..... 347/65
6,286,941 B1 9/2001 Courian et al. ..... 347/65
6,626,522 B2 9/2003 Rapp et al. ..... 347/65

OTHER PUBLICATIONS

European Search Report dated Jun. 7, 2006 issued in EP 05 25 2142.

* cited by examiner

*Primary Examiner*—Juanita D. Stephens
(74) *Attorney, Agent, or Firm*—Stanzione & Kim, LLP

(57) ABSTRACT

An inkjet print head including a chamber layer provided with an ink via, at least one ink chamber having a heater, and at least one ink channel connecting the ink via and the ink chamber; and a nozzle layer provided with at least one nozzle at a position corresponding to the ink chamber. The ink channel is provided with a multi-functional structure. The multi-functional structure performs functions of a filter and a restrictor.

15 Claims, 11 Drawing Sheets

INKJET PRINT HEAD WITH MULTI-FUNCTIONAL STRUCTURE

CROSS-REFERENCE TO RELATED APPLICATIONS

This application claims the benefit of Korean Patent Application No. 2004-37545, filed on May 25, 2004, the disclosure of which is hereby incorporated herein by reference and in its entirety.

BACKGROUND OF THE INVENTION

1. Field of the Invention

The present general inventive concept relates to an inkjet print head, and more particularly, to an inkjet print head performing a mechanism to eject droplets of ink based on a thermal driving type.

2. Description of the Related Art

An inkjet print head is a device for ejecting droplets of ink supplied from an ink cartridge toward a desired position on a printing medium and forming an image such as a character or a picture. The inkjet print head is generally divided into two types, a thermal driving type and a piezoelectric driving type, according to a mechanism ejecting the ink droplets. The thermal driving type inkjet print head makes use of a heater and generates bubbles from the ink to then eject the ink droplets by expansion force of the bubbles. The piezoelectric driving type inkjet print head makes use of a piezoelectric material and ejects the ink droplets by means of pressure which is caused by deformation of the piezoelectric material which in turn is applied to the ink.

The following description will be made in detail regarding the ink droplet ejecting mechanism in the thermal driving type inkjet print head as described above. When a pulse current flows into a heater formed of a resistance type heating element, heat is generated from the heater, and then the ink adjacent to the heater is instantly heated. Thus, the ink is boiled to generate bubbles, and the generated bubbles are inflated to apply pressure to the ink contained in an ink chamber. Thereby, the ink is ejected in a droplet form out of the ink chamber through neighboring ink nozzles. Then, as the bubbles contract within the ink chamber, the droplets begin to be separated from the nozzles. New ink is refilled into the ink chamber, and then the foregoing process of ejecting the ink in the droplet form is repeated.

The thermal driving type inkjet print head may be subdivided into two types, a coupled type and an integrated type, according to a method of forming a chamber layer and a nozzle layer. According to a method of fabricating the integrated type inkjet print head, a plurality of thin layers and circuits are formed on a semiconductor substrate by a semiconductor process, for example a photoresist process, and then the chamber and nozzle layers are integrally formed.

Meanwhile, contaminants or dust particles existing in the ink are responsible for lowering performance of the inkjet print head. In other words, when the contaminants occlude an ink channel, the ink fails to be smoothly supplied into the ink chamber. These contaminants may be introduced in the process of packaging the inkjet print head as well as the ink cartridge. In particular, fine contaminants may still exist in the ink even after the ink passes through a filter of the cartridge. For this reason, in order to improve the performance of the inkjet print head, it is required to filter the contaminants existing in the ink to prevent the ink channel from being occluded by the contaminants.

FIG. 1A is a cross-sectional view showing an example of a conventional inkjet print head 100 capable of filtering contaminants, particularly disclosed in U.S. Pat. No. 6,582,064.

Referring to FIG. 1A, the ink is supplied from an ink via 110 of a chamber layer a through an ink channel 130 to a heater 150 in an ink chamber 120. A nozzle layer b is provided on an upper surface of the chamber layer a. A filter 140 is provided at an entry of the ink channel 130, thereby preventing contaminants 160 from entering the heater 150.

However, the inkjet print head 100 disclosed in U.S. Pat. No. 6,582,064 has a limitation of filtering of the contaminants 160, for example taking a window or rod shape, contained in the ink, because openings 141 defined by the filter 140 are arranged in parallel with respect to an ink introducing path.

FIG. 1B is a plan view showing another example of a conventional inkjet print head 200 capable of filtering contaminants, in which a nozzle layer is separated from a chamber layer.

Referring to FIG. 1B, an ink channel 230 is provided with a plurality of restrictors 260 and filters 240, wherein each filter 240 takes a pillar form. Each restrictor 260 not only applies a proper impedance to the ink supplied from an ink via 210 to a plurality of ink chambers 220, but also inhibits bubbles generated in each ink chamber 220 from expanding toward the ink channel 230, thereby facilitating the refilling of new ink. The filters 240 are formed with a row of insular elements, thereby filtering various kinds of contaminants and simultaneously preventing heaters 250 or nozzles from being clogged.

The restrictors 260 and the filters 240 may be formed either through a semiconductor process such as a photoresist process or a micro electro mechanical system (MEMS) process such as a mold process, a fill-up process or so forth. These restrictors 260 and filters 240 are arranged to alternate with each other, so that the contaminants or dust particles of an elongated spear or bar type are prevented from being introduced into the ink chambers 220.

However, the inkjet print head 200 shown in FIG. 1B is provided with the filters 240 between the heaters 250 and the ink via 210, thus having limitations to enhance a printing speed. Specifically, in order to enhance the printing speed by shortening a refill period of the ink, a distance SH between each center of the heaters 250 and the ink via 210, or a supply port-heater distance, must be as short as possible. Hence, provision of the filters 240 between the heaters 250 and the ink via 210 as in the inkjet print head 200 shown in FIG. 1B experiences limitations to enhance the printing speed.

In addition, the inkjet print head 200 shown in FIG. 1B has a problem in that, because the restrictors 260 are provided to the nozzles respectively, at least one of inlets of the nozzles may be blocked by the contaminants which may be generated during the process of packaging the head and cartridge, and thus the ink can not be ejected through the blocked nozzle.

SUMMARY OF THE INVENTION

Therefore, an aspect of the present general inventive concept provides an inkjet print head capable of improving a printing speed by shortening a distance between the center of a heater and an ink via.

It is also an aspect of the present general inventive concept to provide an inkjet print head capable of improving a printing speed by filtering various kinds of contaminants and simultaneously preventing grown bubbles from expanding toward an ink via to thereby shorten a refill time.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing an inkjet print head including: a chamber layer provided with an ink via, at least one ink chamber having a heater, and at least one ink channel connecting the ink via and the ink chamber; and a nozzle layer provided with at least one nozzle at a position corresponding to the ink chamber. The ink channel is provided with a multi-functional structure which may be formed between two opposite walls extending from the ink chamber to the ink via and to simultaneously perform functions of a filter and a restrictor.

According to an aspect of the present general inventive concept, the multi-functional structure may include a first protrusion protruding toward the heater to perform the restrictor function, and second and third protrusions protruding toward the two walls of the ink channel to perform the filter function.

According to another aspect of the present general inventive concept, the multi-functional structure may include a first protrusion protruding toward the heater to perform the restrictor function, and second and third protrusions having a height lower than that of the first protrusion.

According to yet another aspect of the present general inventive concept, the ink channel may be provided with a restrictor channel in a place where ink is introduced from the ink via.

According to still another aspect of the present general inventive concept, the multi-functional structure may be provided in a restrictor channel of the ink channel.

According to still another aspect of the present general inventive concept, two walls defining the restrictor channel may be tapered toward the ink via in a manner that a distance between the two walls is increased as the two walls approach to the ink via.

The two walls defining the restrictor channel may also be formed to have a height difference with respect to two walls forming the ink channel.

According to still another aspect of the present general inventive concept, the first protrusion may be configured to be perpendicular to a top surface of the heater in order to prevent bubbles generated by the heater from leaking toward the ink via.

The first protrusion may also be set to be spaced apart from the heater by an interval of at least 40 μm.

The first protrusion may also have a width of two thirds or less compared to that of the restrictor channel at which the first protrusion may be located in order to prevent bubbles generated in the ink chamber from leaking toward the ink via.

According to still another aspect of the present general inventive concept, the second and third protrusions may be symmetrically provided with at least one bent part to filter acicular foreign materials.

The second and third protrusions may also be configured to have a width wider than at least 5 μm.

The second and third protrusions may also have a width of half or less compared to that of the restrictor channel.

The second and third protrusions may also be configured to have a symmetrical structure.

The second and third protrusions may also be configured to have an asymmetrical structure.

According to still another aspect of the present general inventive concept, the multi-functional structure may be formed of a polymer-based plate and may be fixed to the chamber by a thermal compression bonding method.

According to still another aspect of the present general inventive concept, the multi-functional structure may be formed of a micro-mold.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
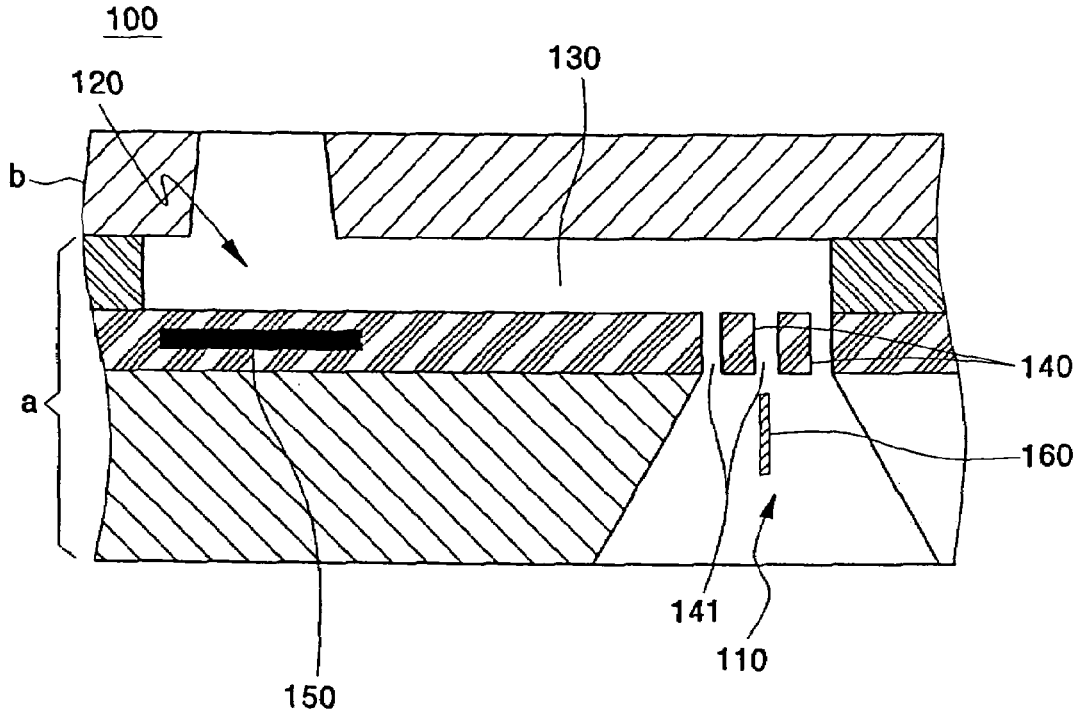
FIG. 1A (PRIOR ART)
FIG. 1A is a cross-sectional view illustrating an example of a conventional inkjet print head capable of filtering contaminants.
Figure 1B:
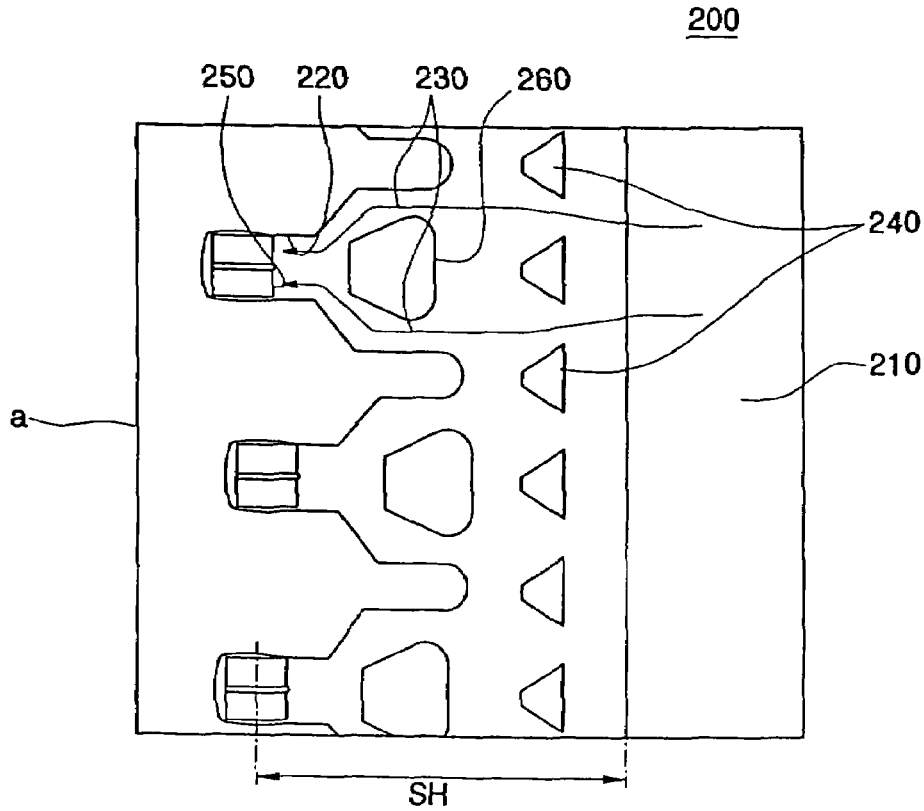
FIG. 1B (PRIOR ART)
FIG. 1B is a plan view illustrating another example of a conventional inkjet print head capable of filtering contaminants, in which a nozzle layer is separated from a chamber layer.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2A:
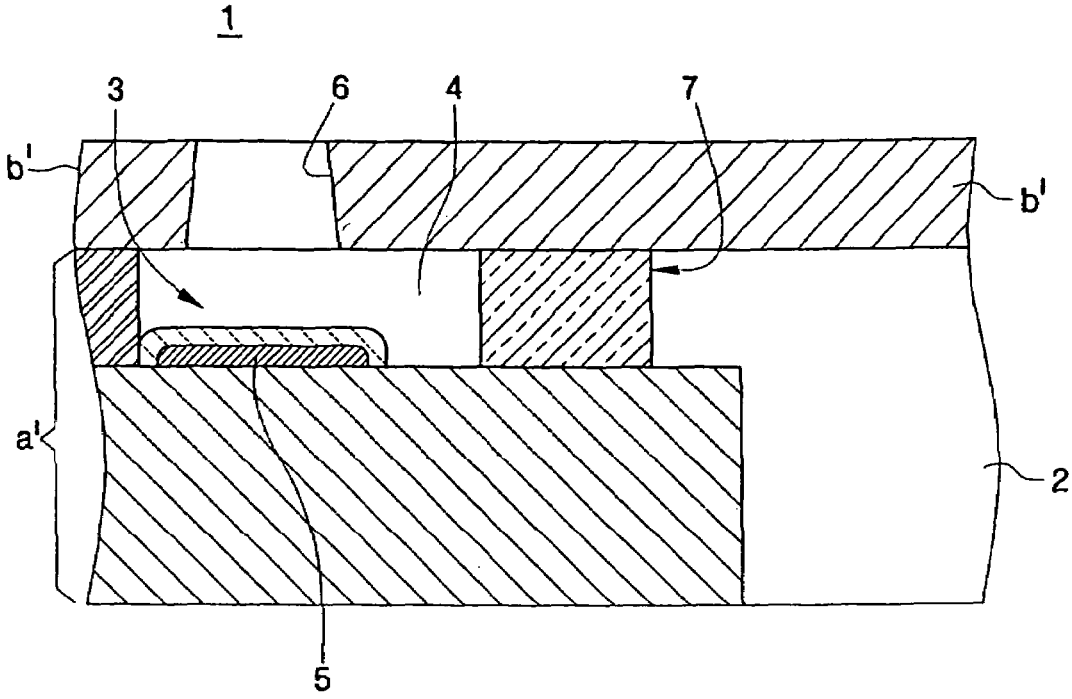
FIG. 2A is a vertical cross-sectional view illustrating, on a magnified scale, a part of an inkjet print head according to an embodiment of the present general inventive concept.
Figure 2B:
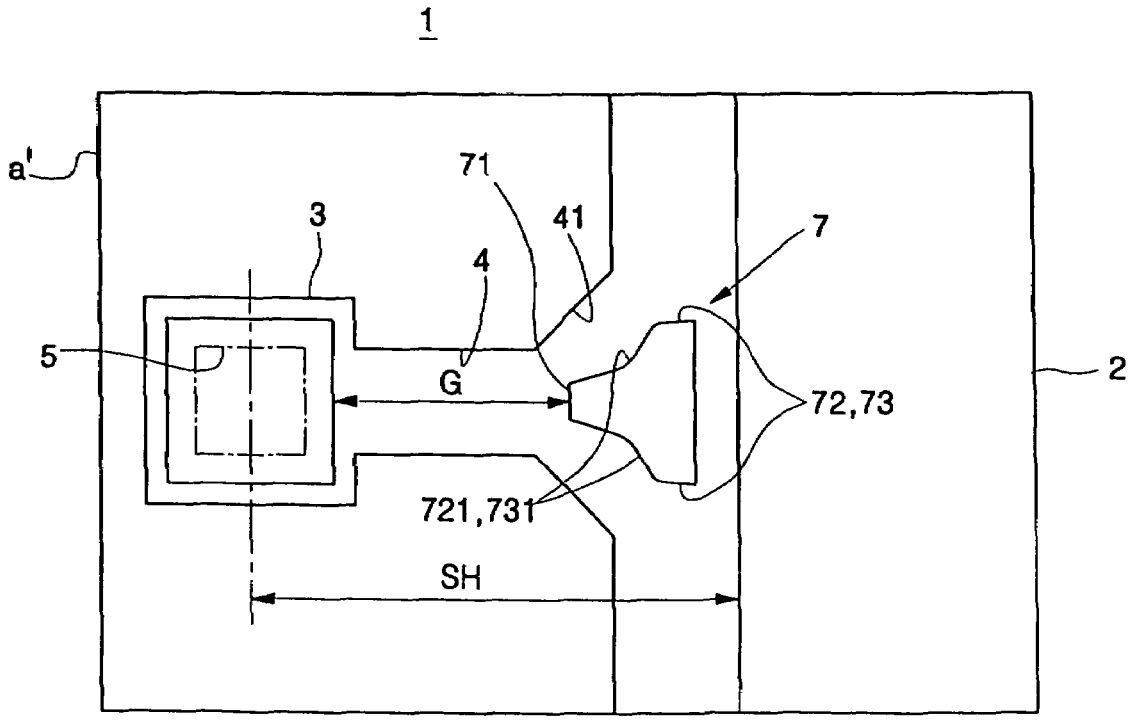
FIG. 2B is a plan view of the inkjet print head in FIG. 2A, in which a nozzle layer is separated therefrom.

FIG. 2A is a vertical cross-sectional view illustrating, on a magnified scale, a part of an inkjet print head 1 according to an embodiment of the present general inventive concept. FIG. 2B is a plan view of the inkjet print 1 in which a nozzle layer b' is separated therefrom.

Referring to FIGS. 2A and 2B, the inkjet print head 1 may comprise a chamber layer a' formed of a plurality of thin layers on a substrate. The chamber layer a' may be provided with an ink via 2 and an ink chamber 3, which may be connected to each other by an ink channel 4. The ink chamber 3 may be provided with a heater 5 or a resistance heating body. The chamber layer a' may be further provided with a circuit (not shown) to supply current to the heater 5. The nozzle layer b' may be provided with a nozzle 6 at a position corresponding to the ink chamber 3.

The ink channel 4 may be formed between two opposite walls which extend from the ink chamber 3 to the ink via 2. The ink channel may be provided with a multi-functional structure 7 to function as a filter and a restrictor at the same time. A detailed description will now be provided with respect to a position where the multi-functional structure 7 may be provided in the ink channel 4. In the ink channel 4, when a portion into which ink is introduced from the ink via 2 is defined as a restrictor channel 41, the multi-functional structure 7 may be formed in the restrictor channel 41.

The multi-functional structure 7 may be a structure where a first protrusion 71, protruding toward the heater 5 to function as the restrictor, is integrated with second and third protrusions 72 and 73 protruding toward the two walls of the restrictor channel 41 to function as the filter. The first protrusion 71 may be adjacent to the heater 5 to the maximum extent so as to prevent bubbles generated by the heater 5 from expanding, and may have a configuration perpendicular to the heater 5.

The two walls forming the restrictor channel 41 may be tapered toward the ink via 2 in such a manner that the two walls are widened as the two walls approach the ink via 2. There may be provided an ink introducing path between the two walls of the restrictor channel 41 and the second and third protrusions 72 and 73. Further, the second and third protrusions 72 and 73 may be provided with bent parts 721 and 731 to filter acicular or needle-like contaminants such as elongated spears or bars, respectively, wherein the bent parts 721 and 731 may be symmetrically bent one or more times.

A driving frequency of the inkjet print head 1 (given by (the number of) droplets per second) may be changed in correspondence with a refill time of the ink, namely, a time to eject old ink through the nozzle 6 and then refill new ink into the ink chamber 3. This refill time is changed according to flow impedances of the nozzle 6 and the ink chamber 3 and the restrictor channel 41.

Figure 7:
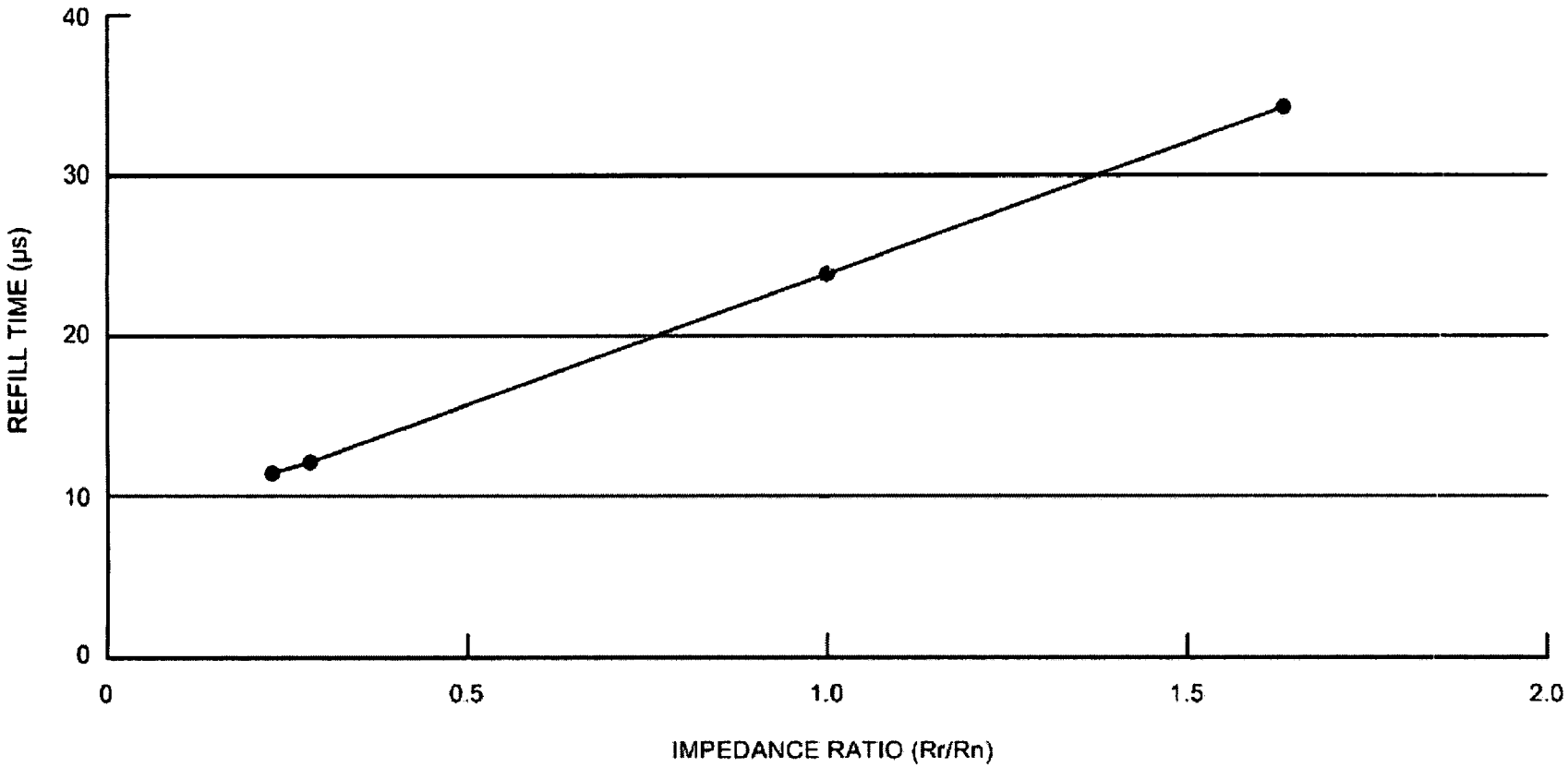
FIG. 7 is a graph illustrating the refill time of an inkjet print head according to a ratio of the flow impedance of the nozzle and ink chamber to the flow impedance of the restrictor channel and ink chamber.

The graph in FIG. 7 represents a numerical analysis result of the refill time of the inkjet print head I according to a flow impedance ratio of Rr/Rn(nozzle+ink chamber)/(restrictor channel+ink chamber).

As represented in graph of FIG.7,it can be seen that the ink refill time is increased in proportion to an increase of the flow impedance ratio, namely, of an impedance of the restrictor channel 41.

As represented in Graph 1, it can be seen that the ink refill time is increased in proportion to an increase of the flow impedance ratio, namely, of an impedance of the restrictor channel 41.

Thus, the multi-functional structure 7, in a particular location, size, length, etc., of the first, second and third protrusions 71, 72 and 73 can be designed in consideration of the ink refill time according to the flow impedance. According to an aspect of the present general inventive concept, the first protrusion 71 can be configured to have an interval G ranging from about 1 μm to about 40 μm with respect to the heater 5 in order to prevent the bubbles from leaking from the ink chamber 3, and simultaneously a width of two thirds or less of a width as compared to that of the restrictor channel 41 where the first protrusion 71 is located. The second and third protrusions 72 and 73 can be configured to have a width of at least 5 μm, and a width of one half or less of a width as compared to that of the restrictor channel 41 of the ink channel 4. The multi-functional structure 7 having this shape has been subjected to a numerical analysis using simulation software (e.g. Flow-3D). The tested results are as follows: an ink ejection speed of about 15 m/s, an ejected droplet amount of about 4.4 picoliters, and a refill time of 45 μs. Therefore, when the driving frequency is calculated from the initial refill time, the driving frequency of about 22 Khz (i.e. 2200 droplets per second) can be obtained, which can meet with performance of a typical color inkjet printer.

Figure 3:
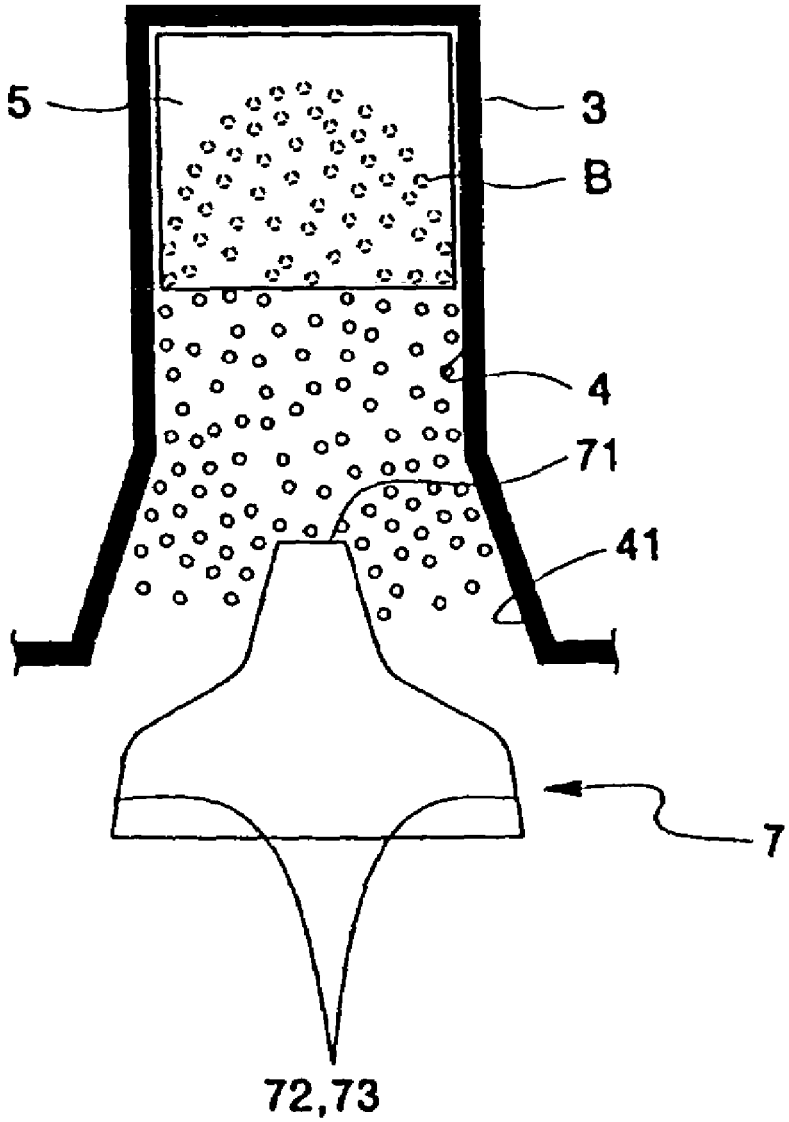
FIG. 3 is a configuration illustrating an operation of a first protrusion of a multi-functional structure in the inkjet print head in FIG. 2A.

FIG. 3 is a configuration illustrating an operation of the first protrusion 71 of the multi-functional structure 7 in the inkjet print head 1.

Referring to FIG. 3, the first protrusion 71 of the multi-functional structure 7 can be formed adjacent and perpendicular to the heater 5, thus preventing bubbles B generated in the ink chamber 3 from expanding. Thereby, the first protrusion 71 is capable of preventing the bubbles B from being pushed toward the ink via 2. Thus, the first protrusion 71 makes it possible to weaken the generated bubbles B at a faster speed, so that it is possible to realize a faster ink refill time and a high frequency. In other words, because increase of the ink ejection speed and a simultaneous acceleration of the ink refill time can be accomplished by preventing expansion of the bubbles B by means of the first protrusion 71 to rapidly weaken the bubbles, it is possible to eject ink droplets at a correct position of a printing medium, thus obtaining a high quality of an image.

Figure 4A:
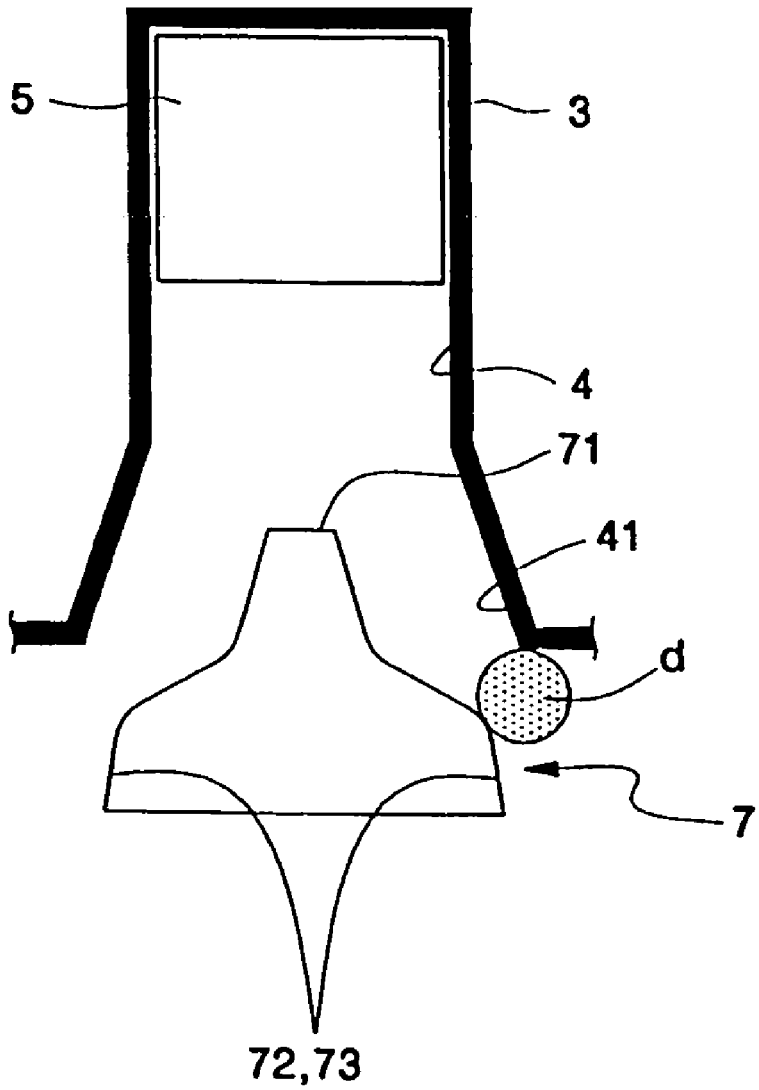
FIGS. 4A and 4B are configurations illustrating operations of second and third protrusions of a multi-functional structure in the inkjet print head in FIG. 2A, respectively.
Figure 4B:
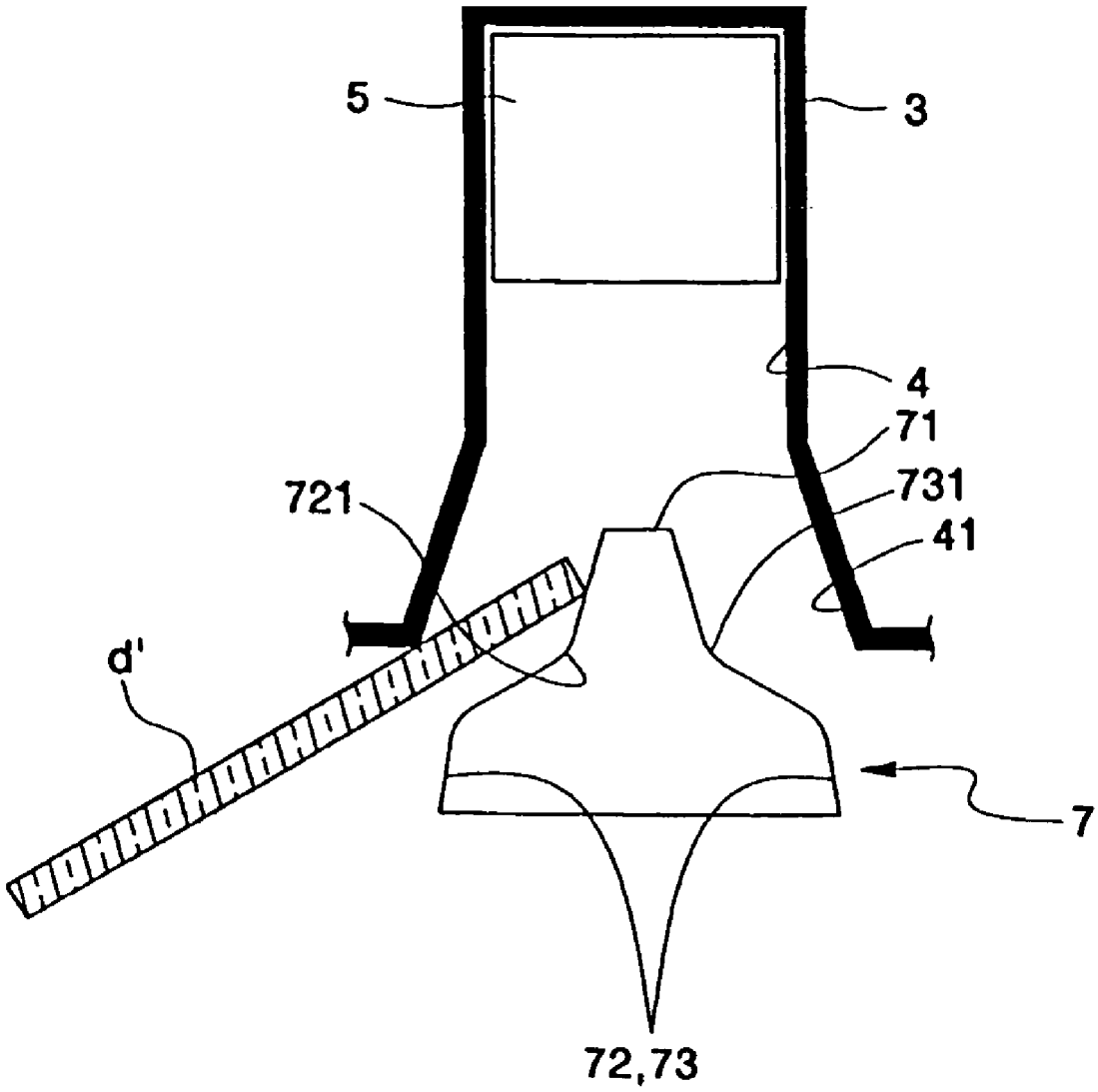

FIGS. 4A and 4B are configurations illustrating operations of the second and third protrusions 72 and 73 of the multi-functional structure 7 in the inkjet print head 1.

Referring to FIG. 4A, the second and third protrusions 72 and 73 of the multi-functional structure 7 may define the ink introducing path between the two walls of the restrictor channel 41, so that it is possible to easily filter spherical and irregular contaminants d having an influence on operation of a heater 5.

Referring to FIG. 4B, the second and third protrusions 72 and 73 may be provided with the bent parts 721 and 731, respectively. The bent parts 721 and 731 may have bent surfaces used to filter foreign materials d' of an acicular shape with ease.

The bent parts 721 and 731 constituting the second and third protrusions 72 and 73 may be configured to be plural in number. Also, the second and third protrusions 72 and 73 may be configured to have a symmetrical or asymmetrical structure.

In particular, the multi-functional structure 7 according to an aspect of the present general inventive concept may have an advantage in that, because the second and third protrusions 72 and 73 may be formed adjacent to an ink chamber 3 in which the bubbles B may be generated, the contaminants may be automatically removed by an expansion force of the bubbles B even when the contaminants block up the ink introducing path defined by the second and third protrusions 72 and 73. In this manner, in the ink introducing path defined by the second and third protrusions 72 and 73, a maximum flow rate of the expanding bubble may amount to a range between about 1 μs and 12 m/s, which may be capable of sufficiently removing even the contaminants which have blocked up the ink introducing path during the packaging process of the head and the cartridge.

The multi-functional structure 7 may be fabricated by, for example, a semiconductor process or a micro electro mechanical system (MEMS) process.

According to the semiconductor process to form the multifunctional structure 7, a polymer-based thin plate (less than 50 μm) may be processed by use of an excimer laser. The multi-functional structure 7 may be formed on the processed thin plate, and then the formed multi-functional structure plate may be fixed to a substrate (silicon wafer), for example, a substrate forming a chamber layer in a manner of thermo-compression bonding.

The multi-functional structure 7 fabricated by the MEMS process may be subjected to a technique of standing up a micro-mold to form chamber and nozzle layers of an inkjet print head.

Accordingly, the inkjet print head 1 of the present general inventive concept may position the multi-functional structure 7, in which the existing restrictors and filters are combined with each other, around the heater 5, so that it is possible to perform etching up to a portion where the existing filters are installed. As a result, because a distance SH between the center of the heater 5 and the end of the ink via 2 can be reduced, it is possible to obtain the high frequency. As a shape of the multi-functional structure 7 becomes simple, it is possible to perform the fabricating process with ease.

In addition, it is possible to filter the contaminants d and d' at a high efficiency and to minimize a phenomenon in which the bubbles B are pushed out of the ink chamber 3, so that it is possible to stabilize the refilling of the ink. Because it is possible to effectively filter the contaminants d and d' which may be generated in the process of packaging the head and the cartridge or from a filter and a foam for the cartridge, the inkjet print head 1 for the high frequency can be realized.

Figure 5A:
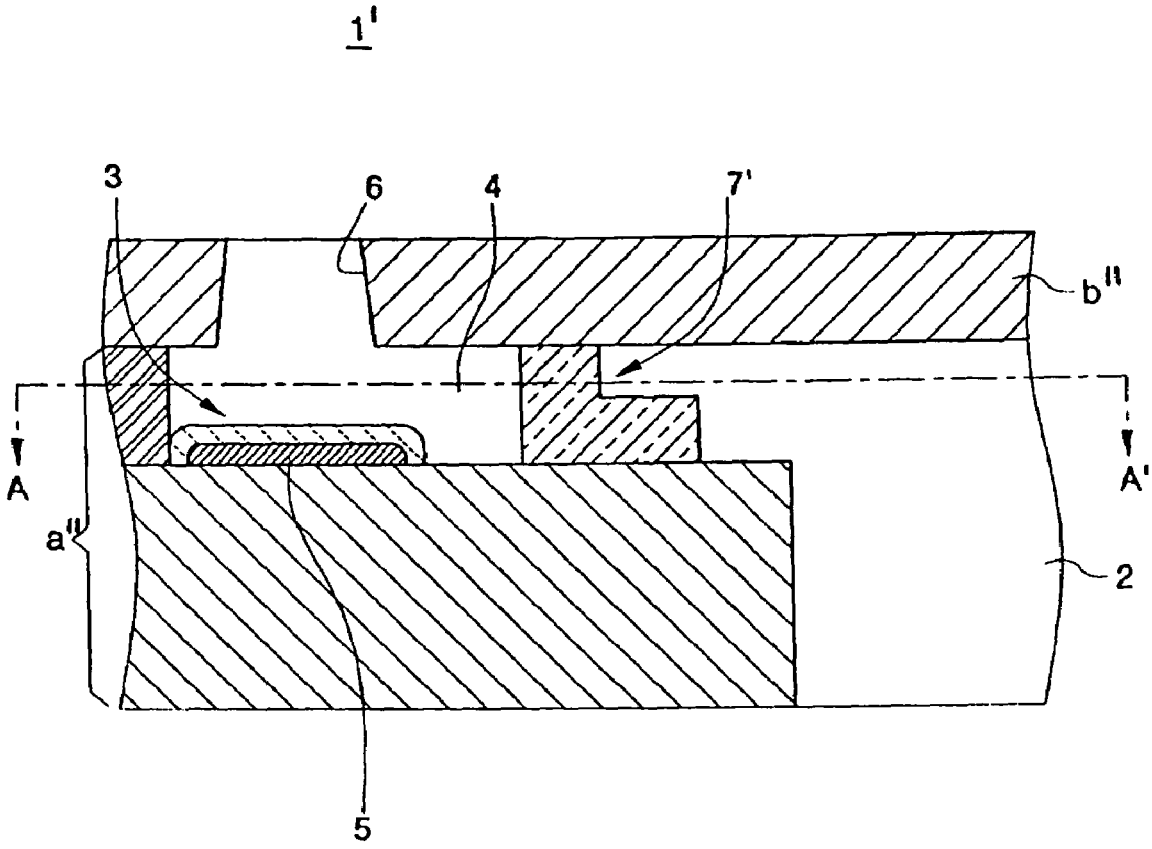
FIG. 5A is a vertical cross-sectional view illustrating, on a magnified scale, a part of an inkjet print head according to another embodiment of the present general inventive concept.
Figure 5B:
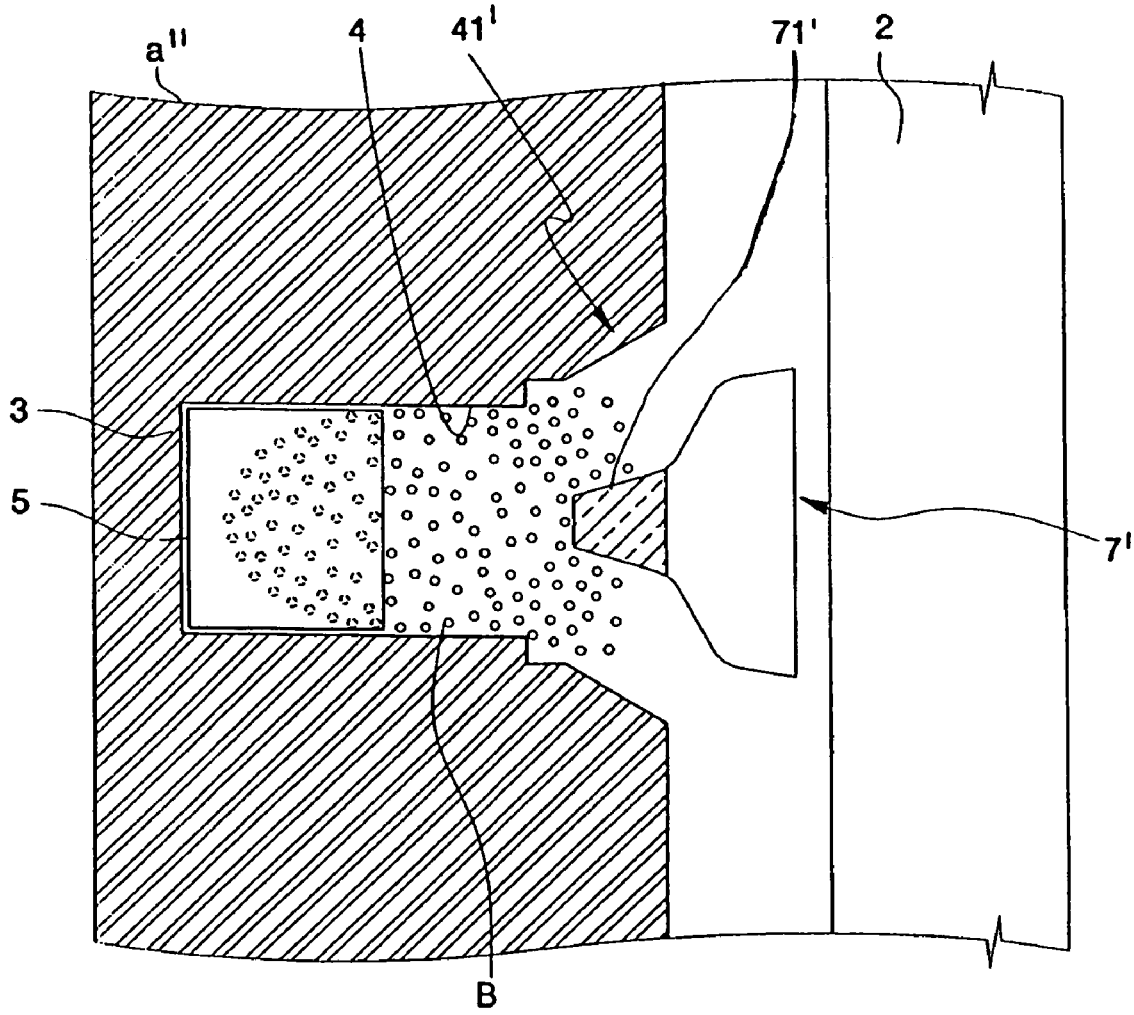
FIG. 5B is a cross-sectional view taken along the line A-A' of FIG. 5A.

FIG. 5A is a vertical cross-sectional view illustrating, on a magnified scale, a part of an inkjet print head 1' according to another embodiment of the present general inventive concept. FIG. 5B is a cross-sectional view taken along a line A-A' of FIG. 5A, and FIG. 5C is a plan view of the inkjet print head 1' in which a nozzle layer b" is separated.

Figure 5C:
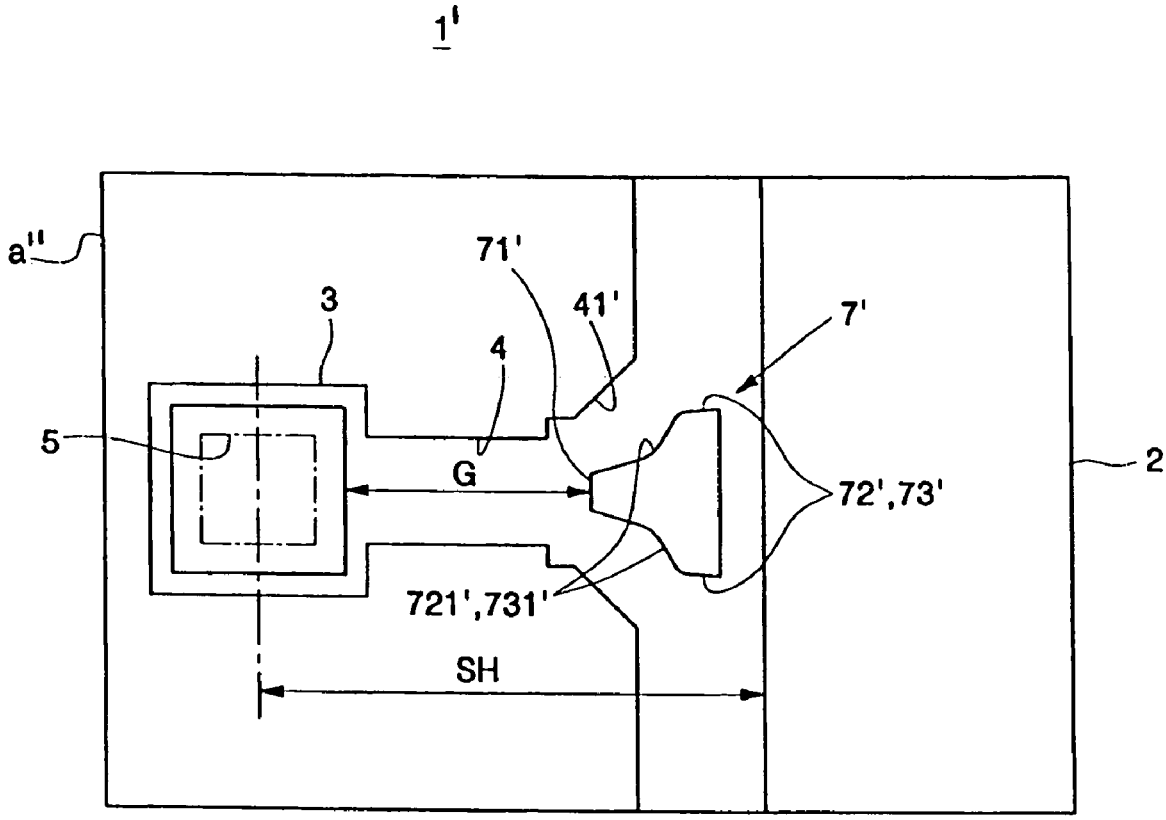
FIG. 5C is a plan view of the inkjet print head in FIG. 5A, in which a nozzle layer is separated.

Referring to FIG. 5A and FIG. 5C, the inkjet print head 1' may be formed so that second and third protrusions 72' and 73' of a multi-functional structure 7' have a height lower than that of a first protrusion 71'. In other words, the second and third protrusions 72' and 73' may be formed to have a height lower than that of the ink channel 4 so as to reduce flow impedance of a restrictor channel 41'. Two walls defining the restrictor channel 41' may be tapered toward the ink via 2 in such a manner that the two walls may be widened as the two walls approach the ink via 2, and each may be formed to additionally provide a step. This structure of the restrictor channel 41' may be applied to that of the foregoing embodiment, and vice versa.

Referring to FIG. 5B, the first protrusion 71' may be located in the restrictor channel 41' in order to reinforce a function of inhibiting expansion of the bubbles B. The first protrusion 71' can be configured to be perpendicular to a top surface of the heater 5 in order to prevent the bubbles from leaking out of the ink chamber 3. Also, the first protrusion 71' can be configured to have an interval G between about 1 μm and about 40 μm with respect to the heater 5 in consideration of a refilling time of the ink, and simultaneously a width of two thirds or less compared to that of the restrictor channel 41' where the first protrusion 71' may be located. Therefore, the first protrusion 71' may be capable of weakening the generated bubbles at a faster speed, so that it may be possible to obtain a short ink refill time as well as a high frequency.

Referring to FIG. 5A and FIG. 5C, the second and third protrusions 72' and 73' may be configured to have a height difference of about 4 μm or more with respect to the first protrusion 71'. The second and third protrusions 72' and 73' may be provided with bent parts 721' and 731' respectively, so as to filter acicular foreign materials d', wherein the bent parts 721' and 731' may be formed in a symmetrical form. Each of the second and third protrusions 72' and 73' may have a width of at least 5 μm, and simultaneously a width of one half or less of a width as compared to that of the restrictor channel 41'.

Figure 6A:
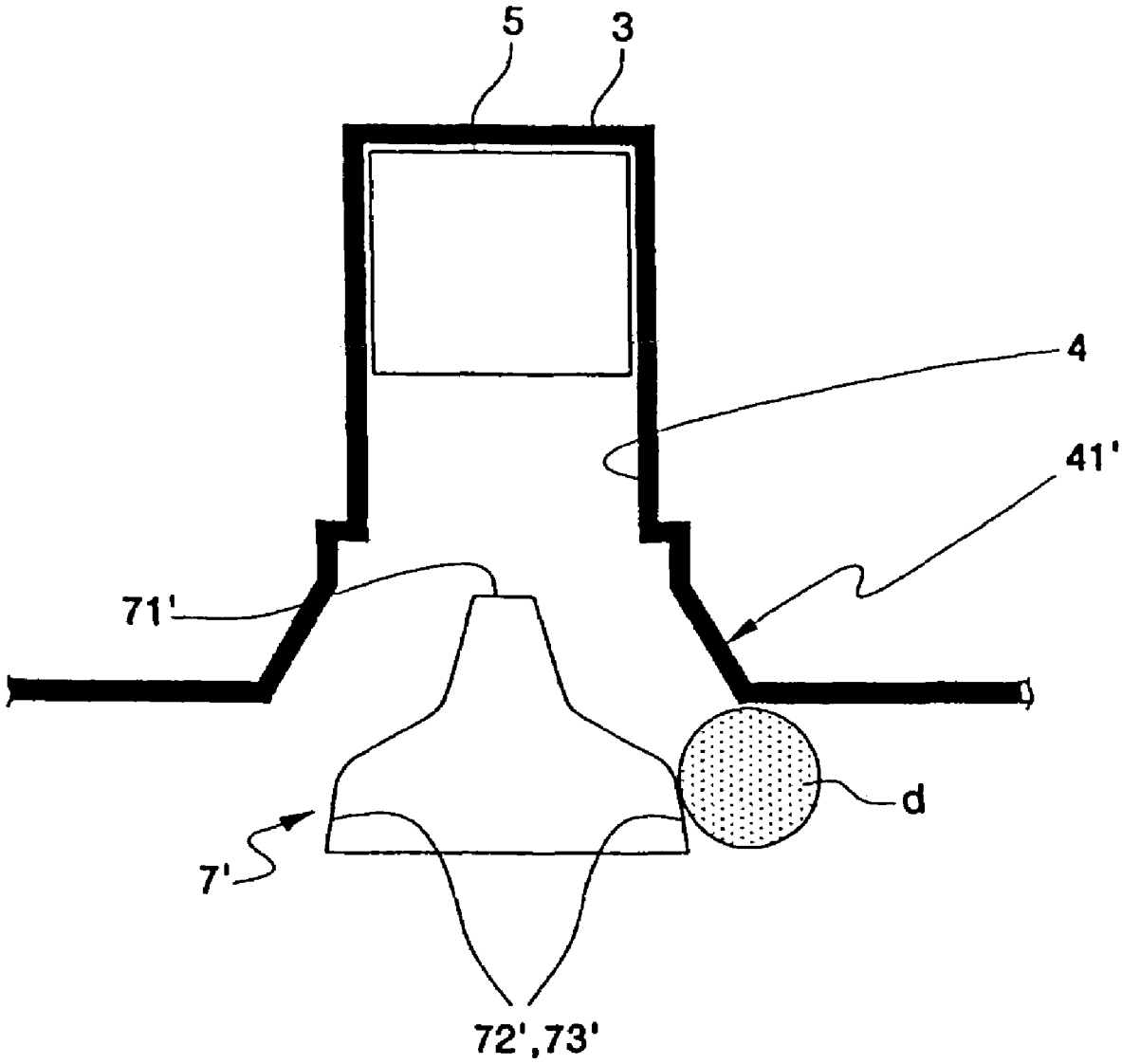
FIGS. 6A and 6B are configurations illustrating operations of second and third protrusions of a multi-functional structure in the inkjet print head in FIG. 5A, respectively.
Figure 6B:
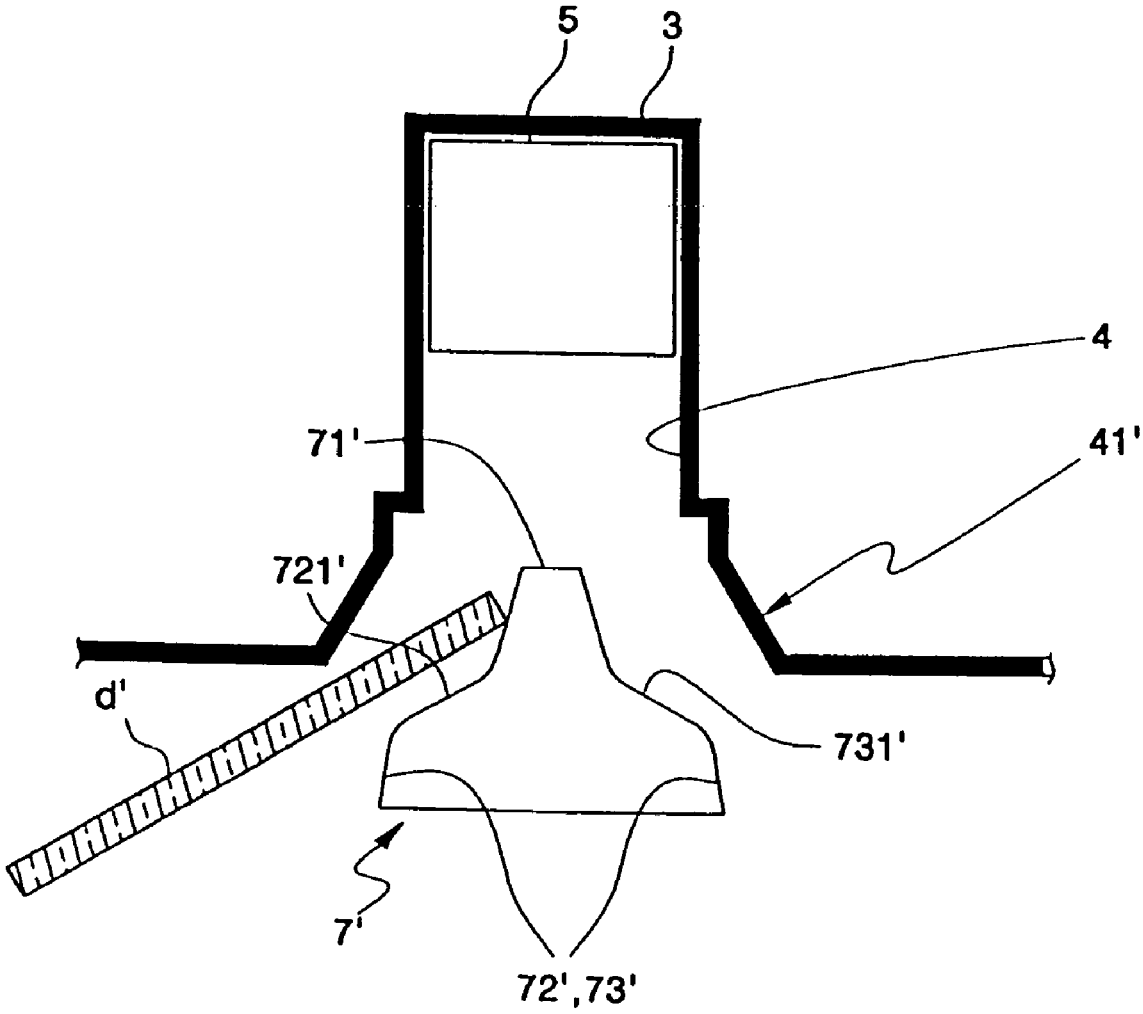

FIGS. 6A and 6B are configurations illustrating operations of the second and third protrusions 72' and 73' of the multi-functional structure 7' in the inkjet print head 1'.

Referring to FIG. 6A, the second and third protrusions 72' and 73' of the multi-functional structure 7' may define an ink introducing path between two walls of the restrictor channel 41' of an ink channel 4, so that it may be possible to easily filter spherical and irregular contaminants d having an influence on operation of the heater 5.

Referring to FIG. 6B, the second and third protrusions 72' and 73' may be provided with the bent parts 721' and 731' respectively, so that it may be possible to filter the acicular foreign materials d' using bent surfaces of the bent parts 721' and 731'.

The bent parts 721' and 731' provided to the second and third protrusions 72' and 73' may be configured to be a plural in number. Also, the second and third protrusions 72' and 73' may be configured to have a symmetrical or asymmetrical structure.

In particular, the multi-functional structure 7' according to the present general inventive concept has an advantage in that, because the second and third protrusions 72' and 73' may be formed adjacent to the ink chamber 3 in which the bubbles B may be generated, the contaminants d and d' may be automatically removed by an expansion force of the bubbles B, even when the contaminants d and d' block up the ink introducing path defined by the second and third protrusions 72' and 73'. In this manner, in the ink introducing path defined by the second and third protrusions 72' and 73', a maximum flow rate of the expanding bubble B may amount to a range between about 1 μs and 28 m/s, which is faster than that of the previous embodiment, and may be capable of sufficiently removing even the contaminants d and d' which have blocked up the ink introducing path during the packaging process of the inkjet print head 1' and the cartridge.

The multi-functional structure 7' may be fabricated through a semiconductor process or an MEMS process.

According to the semiconductor process to form the multifunctional structure 7', a polymer-based thin plate (less than 50 μm) may be processed by use of an excimer laser. The multi-functional structure 7' may be formed on the processed thin plate, and then the formed multi-functional structure plate may be fixed to a substrate (silicon wafer), for example, forming a chamber layer in a manner of thermo-compression bonding.

The multi-functional structure 7' fabricated by the MEMS process may be subjected to a technique of standing up a micro-mold to form chamber and nozzle layers of an inkjet print head. The multi-functional structure 7' can be formed into a single structure having a step or a height difference. For this reason, the multi-functional structure 7' may be fabricated in a manner that a structure may be formed at a height of the second and third protrusions 72' and 73', and then the first protrusion 71' is stacked on the formed structure.

Accordingly, the inkjet print head 1' of the present embodiment may position the first protrusion 71' of the multi-functional structure 7' in the restrictor channel 41', so that it is possible to reinforce a restrictor function to prevent the bubbles B from expanding. In addition, the second and third protrusions 72' and 73' may be formed to have a height lower than that of the ink channel 4 in order to reduce flow impedance of the restrictor channel 41. As a result, it is possible to reduce a flow impedance ratio of the ink, and ultimately to shorten the refill time of the ink.

As can be seen from the foregoing, the inkjet print head 1' according to the present general inventive concept provides the multi-functional structure 7' to serve as the restrictor and the filter in the ink channel 4, so that the distance between the center of the heater 5 and the ink via 2 can be reduced, and thus it is possible to improve frequency properties. In addition, the inkjet print head 1' filters various kinds of foreign materials and prevents the bubbles 5 from expanding to shorten the ink refill time, thereby realizing high efficiency and high frequency.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet print head, comprising:

a chamber layer provided with an ink via, at least one ink chamber having a heater, and at least one ink channel connecting the ink via and the ink chamber;

a nozzle layer provided with at least one nozzle at a position corresponding to the ink chamber; and a multi-functional structure formed between two opposite walls of the ink channel extending from the ink chamber to the ink via to simultaneously perform functions of a filter and a restrictor,the multi-functional structure having a first protrusion protruding toward the heater to perform the restrictor function, and second and third protrusions to perform the filter function and symmetrically provided with at least one bent part to filter acicular foreign materials, the first protrusion and the second and third protrusions being integrally formed.

2. An ink jet print head, comprising:

a chamber layer having an ink via, an ink chamber, and an ink channel connecting the ink via and ink chamber, the ink chamber including a heat resistance body to heat ink therein;

a nozzle layer including a nozzle positioned corresponding to the ink chamber;

a filter formed within the ink channel between two walls extending from the ink chamber to the ink via to filter refill ink into the ink chamber; and a restrictor integrally formed with the filter in a single body to restrict bubbles generated by the heat resistance body.

3. The inkjet print head as set forth in claim 2, wherein two walls defining a restrictor channel at an inlet to the ink channel are formed to have a height difference with respect to two walls forming the ink channel.

4. The ink jet print head as set forth in claim 2 wherein the filter includes second and third protrusions each extending toward a respective one of the two walls of the ink channel.

5. The inkjet print head as set forth in claim 4 wherein two walls defining a restrictor channel are formed at an inlet to the ink channel, the second and third protrusions having a width of half or less than that of the restrictor channel.

6. The inkjet print head as set forth in claim 5 wherein the second and third protrusions are configured to have a width wider than at least 5 μm.

7. The ink jet print head as set forth in claim 4, wherein each of the two walls taper inward toward the ink chamber at a position adjacent to the respective one of the second and third protrusions.

8. The ink jet print head as set forth in claim 4 wherein the second and third protrusions are each provided with bent parts to filter needle-like contaminants from entering the ink channel.

9. The ink jet print head as set forth in claim 4 wherein the second and third protrusions have a height lower than that of the first protrusion.

10. The ink jet print head as set forth in claim 4 wherein the second and third protrusions are formed symmetrically to each other.

11. The ink jet print head as set forth in claim 2, wherein the restrictor includes a first protrusion extending toward the ink chamber.

12. An ink jet print head comprising:

a chamber layer having an ink via, and an ink chamber, an ink channel connecting the ink via and the ink chamber, the ink chamber including a heat resistance body to heat ink therein;

a nozzle layer including a nozzle positioned corresponding to the ink chamber;

a valve formed within the ink channel between two walls extending from the ink chamber to the ink via to filter refill ink entering the ink chamber and to restrict bubbles generated by the heat resistance body.

13. A method of operating an ink jet print head, the method comprising:

supplying ink to an ink chamber from an ink via through an ink channel;

controlling a heater to generate heat;

heating the ink with the heat to create bubbles;

preventing the bubbles from leaking toward the ink via from the ink chamber with a first protrusion of a multifunctional structure while simultaneously filtering the supply ink with second and third protrusions of a multifunctional structure;

ejecting ink droplets with an expansion force of the bubbles; and removing contaminants from an inlet to the ink channel as filtered by the multifunctional structure by the expansion force of the bubbles.

14. The method of operating an ink jet print head as set forth in claim 13, wherein the filtering operation further comprises filtering acicular contaminants with at least one bent part symmetrically provided to each of the second and third protrusions.

15. An ink jet print head comprising:

an ink via to supply ink;

an ink chamber to expulse ink droplets through a nozzle thereof;

an ink channel in fluid communication with the ink chamber to provide ink from the ink via thereto; and a multi-function structure received in a terminating end of the ink channel to form at least one restrictor channel therein, the multi-function structure extending outside of the ink channel toward the ink via to filter contaminants from the ink drawn therefrom.

* * * * *